US008033135B2

(12) United States Patent
Okaichi et al.

(10) Patent No.: US 8,033,135 B2
(45) Date of Patent: Oct. 11, 2011

(54) ROTARY-TYPE FLUID MACHINE AND REFRIGERATION CYCLE APPARATUS

(75) Inventors: Atsuo Okaichi, Osaka (JP); Hiroshi Hasegawa, Osaka (JP); Masaru Matsui, Kyoto (JP); Tomoichiro Tamura, Kyoto (JP); Takeshi Ogata, Osaka (JP)

(73) Assignee: Panasonic Corporation, Osaka (JP)

( * ) Notice: Subject to any disclaimer, the term of this patent is extended or adjusted under 35 U.S.C. 154(b) by 703 days.

(21) Appl. No.: 12/066,450

(22) PCT Filed: Sep. 12, 2006

(86) PCT No.: PCT/JP2006/318046

§ 371 (c)(1),
(2), (4) Date: Mar. 11, 2008

(87) PCT Pub. No.: WO2007/032337

PCT Pub. Date: Mar. 22, 2007

(65) Prior Publication Data

US 2009/0155111 A1 Jun. 18, 2009

(30) Foreign Application Priority Data

Sep. 12, 2005 (JP) ..... 2005-263381

(51) Int. Cl.
*F25B 43/02* (2006.01)
*F04C 23/00* (2006.01)

(52) U.S. Cl. ..... 62/468; 417/313

(58) Field of Classification Search ..... 62/84, 175, 62/270, 402, 468, 469, 510; 417/313, 368, 417/371, 372, 405, 410.3, 423.12, 423.13, 417/427, 902; 418/3, 11, 15, 16, 22, 23, 418/55, 57, 60, 61.1, 63, 75, 88, 89, 94, 97, 418/248; 29/888.02

See application file for complete search history.

(56) References Cited

U.S. PATENT DOCUMENTS 2,228,364 A * 1/1941 Philipp ..... 417/415

(Continued)

FOREIGN PATENT DOCUMENTS

EP 1 371 852 12/2003

(Continued)

OTHER PUBLICATIONS

Refrigerating and Air Conditioning Handbook, New Edition Fifth Edition, vol. II, Equipment (Japanese Association of Refrigeration), 1993, pp. 30-43.

*Primary Examiner* — Frantz F. Jules
*Assistant Examiner* — Emmanuel Duke
(74) *Attorney, Agent, or Firm* — Hamre, Schumann, Mueller & Larson, P.C.

(57) ABSTRACT

A rotary-type fluid machine (10A) includes: a closed casing (1) having a bottom portion utilized as an oil reservoir, a rotary-type fluid mechanism (expansion mechanism) (15) that is provided in an upper portion of the closed casing (1) and in which working chambers (32, 33) in cylinders (22, 24) are partitioned into a suction side working chamber and a discharge side working chamber by vanes (28, 29), a shaft (5) having therein an oil supply passage (51) for supplying oil to the fluid mechanism (15), the shaft being connected to the fluid mechanism (15) and extending an oil reservoir (45), an oil pump (52) provided at a lower portion of the shaft (5), an oil retaining portion (65) for retaining oil, which is pumped up by the oil pump (52) and supplied through the oil supply passage (51), in a surrounding region around the fluid mechanism (15) to allow the partitioning members of the fluid mechanism (15) to be lubricated, the oil retaining portion formed so that the liquid level of the oil retained therein is positioned higher the lower face of the partitioning members (28, 29).

10 Claims, 8 Drawing Sheets

U.S. PATENT DOCUMENTS

| | | | | |
|---|---|---|---|---|
| 4,971,529 | A * | 11/1990 | Gannaway et al. | 417/313 |
| 5,169,299 | A | 12/1992 | Gannaway | |
| 6,527,085 | B1 | 3/2003 | Paczuski | |
| 2004/0141859 | A1 * | 7/2004 | Narney, II | 417/410.3 |
| 2007/0053782 | A1 | 3/2007 | Okamoto et al. | |

FOREIGN PATENT DOCUMENTS

| | | | |
|---|---|---|---|
| EP | 1 726 778 | A1 | 11/2006 |
| JP | 48-010610 | A | 2/1973 |
| JP | 07-247981 | * | 9/1995 |
| JP | 2001-214876 | | 8/2001 |
| JP | 2003-139059 | A | 5/2003 |
| JP | 2005-106046 | A | 4/2005 |
| JP | 2005-106064 | A | 4/2005 |
| JP | 2006-132329 | A | 5/2006 |
| JP | 2006-132332 | A | 5/2006 |
| JP | 2006-132377 | A | 5/2006 |
| WO | WO 2005/088078 | A1 | 9/2005 |

* cited by examiner

- PRIOR ART -

- PRIOR ART -

ROTARY-TYPE FLUID MACHINE AND REFRIGERATION CYCLE APPARATUS

TECHNICAL FIELD

The present invention relates to a rotary-type fluid machine used for a refrigeration air-conditioner and the like. Particularly, the present invention relates to a rotary-type fluid machine in which a rotary-type fluid mechanism is provided in an upper portion of a closed casing. The invention also relates to a refrigeration cycle apparatus using the rotary-type fluid machine.

BACKGROUND ART

Conventionally, a rotary-type fluid machine has been used as a fluid machine for compressing or expanding a working fluid such as represented by a refrigerant. Because of its compactness and simple structure, the rotary-type compressor has been used widely for electric appliances, such as air-conditioners, water heaters, and refrigerator-freezers. A configuration of the rotary-type compressor is disclosed in, for example, "Refrigerating and Air Conditioning Handbook, New Edition Fifth Edition, Vol. II, Equipment (Japanese Association of Refrigeration, 1993, pp. 30-43)". The following describes the configuration of the conventional rotary-type compressor with reference to FIG. 7. FIG. 7 is a vertical cross-sectional view illustrating the conventional rotary-type compressor.

A rotary-type compressor 120 shown in FIG. 7 includes a closed casing 101, a compression mechanism 122 provided in a lower portion of the closed casing 101, and an electric motor 124 provided above the compression mechanism 122. The compression mechanism 122 includes a shaft 102 having an eccentric portion 102*a*, a cylinder 103, a roller 104, a vane 105, a spring 106, an upper bearing member 107 having a discharge port 107*a*, and a lower bearing member 108. The motor 124 includes a stator 109 and a rotor 110 fixed to the shaft 102.

A suction pipe 111 and a discharge pipe 112 are connected to the closed casing 101. An oil reservoir 113 is formed in a bottom portion of the closed casing 101 by accumulating oil, whereby the surrounding region of the compression mechanism 122 is filled with the oil. At the top of the closed casing 101, a terminal 114 for supplying electric power to the motor 124 from the outside extends through the closed casing 101.

The operation of the rotary-type compressor 120 having the above-described configuration is described below.

When electric current passes through the terminal 114 to the motor 124 and the rotor 110 rotates, the roller 104 undergoes eccentric rotational motion by the action of the eccentric portion 102*a*. As a result, the refrigerant is sucked from the suction pipe 111 and a suction port 103*a*, and compressed in a compression chamber 115. The compressed refrigerant blows out into the internal space of the closed casing 101 through the discharge port 107*a*. The refrigerant blown out into the closed casing 101 is discharged from the discharge pipe 112 toward a radiator.

Here, the sliding operation of the cylinder 103 and the vane 105 during the period in which the rotary-type compressor 120 is performing the compression operation is described below.

The cylinder 103, the roller 104, the vane 105, the upper bearing member 107, and the lower bearing member 108 form two compression chambers 115*a*, 115*b*. Two compression chambers 115*a* and 115*b* include the compression chamber 115*a* communicating with the suction port 103*a* on the suction stroke, and the compression chamber 115*b* communicating with the discharge port 107*a* on the compression/discharge stroke. The compression chamber 115*a* on the suction stroke is filled with the refrigerant at a suction pressure (low pressure). The compression chamber 115*b* on the compression/discharge stroke is filled with the refrigerant at an intermediate pressure that is between the suction pressure (low pressure) and a discharge pressure (high pressure) when in the compression stroke, or is filled with the refrigerant at the same discharge pressure (high pressure) as that in the closed casing 101 when in the discharge stroke after the compression has finished. As a result, in the cylinder 103, there exists a region with a suction pressure (low pressure) and a region with an intermediate pressure or a discharge pressure (high pressure), and there is a portion with a lower pressure than a discharge pressure (high pressure) of the refrigerant filled in the closed casing 101.

Accordingly, oil is supplied directly from the oil reservoir 113 to sliding portions of the cylinder 103 and the vane 105 because of the pressure difference between the interior of the closed casing 101 and the interior of the cylinder 103. The oil flows toward the interior of the cylinder 103, lubricating the whole sliding surfaces.

The rotary-type fluid machine is also useful as an expander. Because of its compactness and simple structure, use of the rotary-type expander in place of an expansion valve has been studied for recovering the energy of expansion of the refrigerant during the process of decompressing a high-pressure refrigerant. An example of the configuration of such a rotary-type expander is a fluid machine in which a rotary-type compression mechanism and a rotary-type expansion mechanism are constructed integrally, as disclosed in JP 2005-106046A and JP 2005-106064A. This kind of fluid machine often is referred to as an expander-compressor unit.

The configuration of the fluid machine disclosed in JP 2005-106046A and JP 2005-106064A will be described below with reference to the vertical cross-sectional view of FIG. 8.

A fluid machine 200 shown in FIG. 8 includes a closed casing 201, a compression mechanism 202, a motor 203, a rotary-type expansion mechanism 204, a shaft 205, and an oil reservoir 206. The compression mechanism 202 is provided in a lower portion of the closed casing 201. The rotary-type expansion mechanism 204 is provided above the motor 203. The shaft 205 couples the compression mechanism 202, the motor 203, and the expansion mechanism 204 to each other. The oil reservoir 206 is provided in a bottom portion of the closed casing 201, for filling the circumference of the compression mechanism 202 with oil.

The operation of the fluid machine 200 having the above-described configuration is described below.

When electric current is passed to the motor 203, mechanical power is generated at the motor 203. The mechanical power is transmitted to the compression mechanism 202 by the shaft 205. The compression mechanism 202 sucks and compresses the refrigerant discharged from an evaporator, and discharges the compressed refrigerant to the interior of the closed casing 201. The refrigerant discharged to the interior of the closed casing 201 then is discharged toward a radiator. The refrigerant cooled by the radiator is guided to the expansion mechanism 204 and is expanded at the expansion mechanism 204, while the energy of expansion there is being recovered as mechanical power. Then, the refrigerant after the expansion is heated by the evaporator and is again sucked into the compression mechanism 202.

In the fluid machine 200 with the just-described configuration, the expansion mechanism 204, the motor 203, and the compression mechanism 202 are aligned in that order from the top to the bottom. Since the compression mechanism 202 is immersed in oil, as in the case of the conventional rotary-type compressor (FIG. 7), sliding portions of the cylinder and the vane are lubricated by the same principle as described previously.

DISCLOSURE OF THE INVENTION

However, the expansion mechanism 204 provided in the upper portion of the closed casing 201 is not immersed in oil, and therefore, it is difficult to lubricate the cylinder and the vane stably.

The present invention has been accomplished to solve the foregoing problem, and it is an object of the invention to make it possible to supply oil to the sliding portion between the cylinder and the vane even when the rotary-type fluid mechanism is provided away from the oil reservoir in the bottom portion.

Accordingly, the present invention provides a rotary-type fluid machine including:

a closed casing having a bottom portion defining an oil reservoir;

a rotary-type fluid mechanism provided in an upper portion of the closed casing, the rotary-type fluid mechanism having a cylinder forming a working chamber and a partitioning member, the working chamber partitioned into a suction side working chamber and a discharge side working chamber by the partitioning member;

a shaft having therein an oil supply passage for supplying oil to the fluid mechanism, the shaft connected to the fluid mechanism and extending to the oil reservoir;

an oil pump provided at a lower portion of the shaft; and an oil retaining portion for retaining oil, supplied by the oil pump through the oil supply passage, in a region around the fluid mechanism to allow the partitioning member of the fluid mechanism to be lubricated, the oil retaining portion formed so that a liquid level of the oil retained therein is positioned higher than a lower face of the partitioning member.

This configuration makes it possible to supply oil stably to the partitioning member of the rotary-type fluid mechanism provided away from the oil reservoir of the bottom portion in the closed casing, thereby preventing damage to the sliding portions such as seizure. Moreover, the oil supplied to the gap between the partitioning member and the cylinder serves to prevent the refrigerant from leaking, thereby improving the efficiency of the fluid machine. Furthermore, since the oil retaining portion serves to keep the condition in which the oil is retained in a region around the rotary-type fluid mechanism even when the fluid machine is not in operation, it is possible to supply a sufficient amount of oil to the partitioning member when restarting the operation.

The present invention also provides a refrigeration cycle apparatus including:

a compressor for compressing a refrigerant;

a radiator for cooling the refrigerant compressed by the compressor;

an expander for expanding the refrigerant cooled by the radiator; and an evaporator for evaporating the refrigerant expanded by the expander, wherein at least one of the compressor and the expander includes the rotary-type fluid machine.

BEST MODE FOR CARRYING OUT THE INVENTION

Hereinbelow, preferred embodiments of the present invention are described with reference to the drawings. It should be noted that in the present specification, the direction parallel to the axis direction of the shaft is defined as the vertical direction.

Embodiment 1

Figure 1:
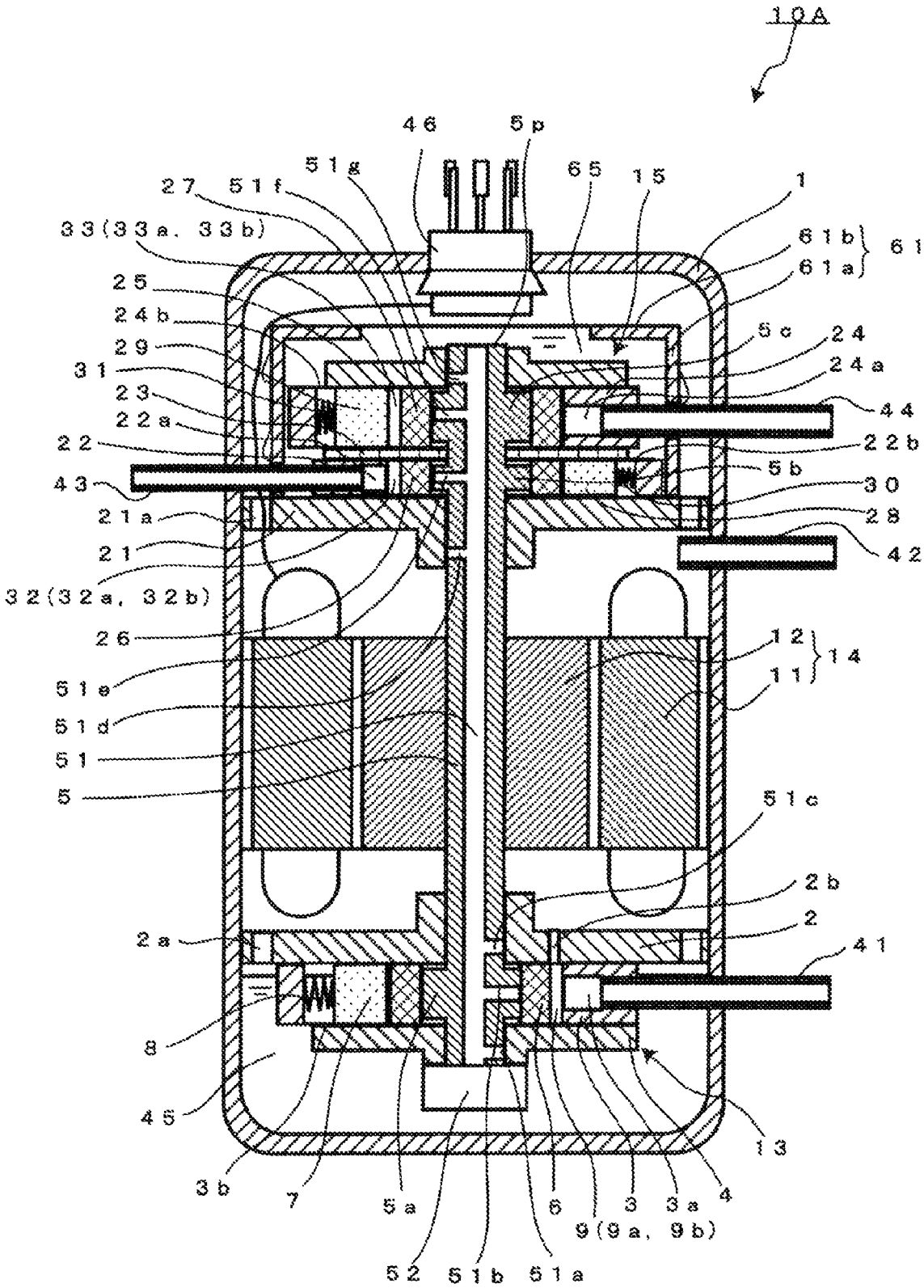
FIG. 1 is a vertical cross-sectional view illustrating a rotary-type fluid machine according to Embodiment 1 of the present invention.

FIG. 1 is a vertical cross-sectional view illustrating a rotary-type fluid machine 10A according to Embodiment 1 of the present invention. The rotary-type fluid machine 10A of the present embodiment 1 has a closed casing 1, a rotary-type compression mechanism 13 provided in a lower portion of the closed casing 1, a rotary-type expansion mechanism 15 provided in an upper portion of the closed casing 1, and a motor 14 provided between the rotary-type compression mechanism 13 and the rotary-type expansion mechanism 15.

Figure 2:
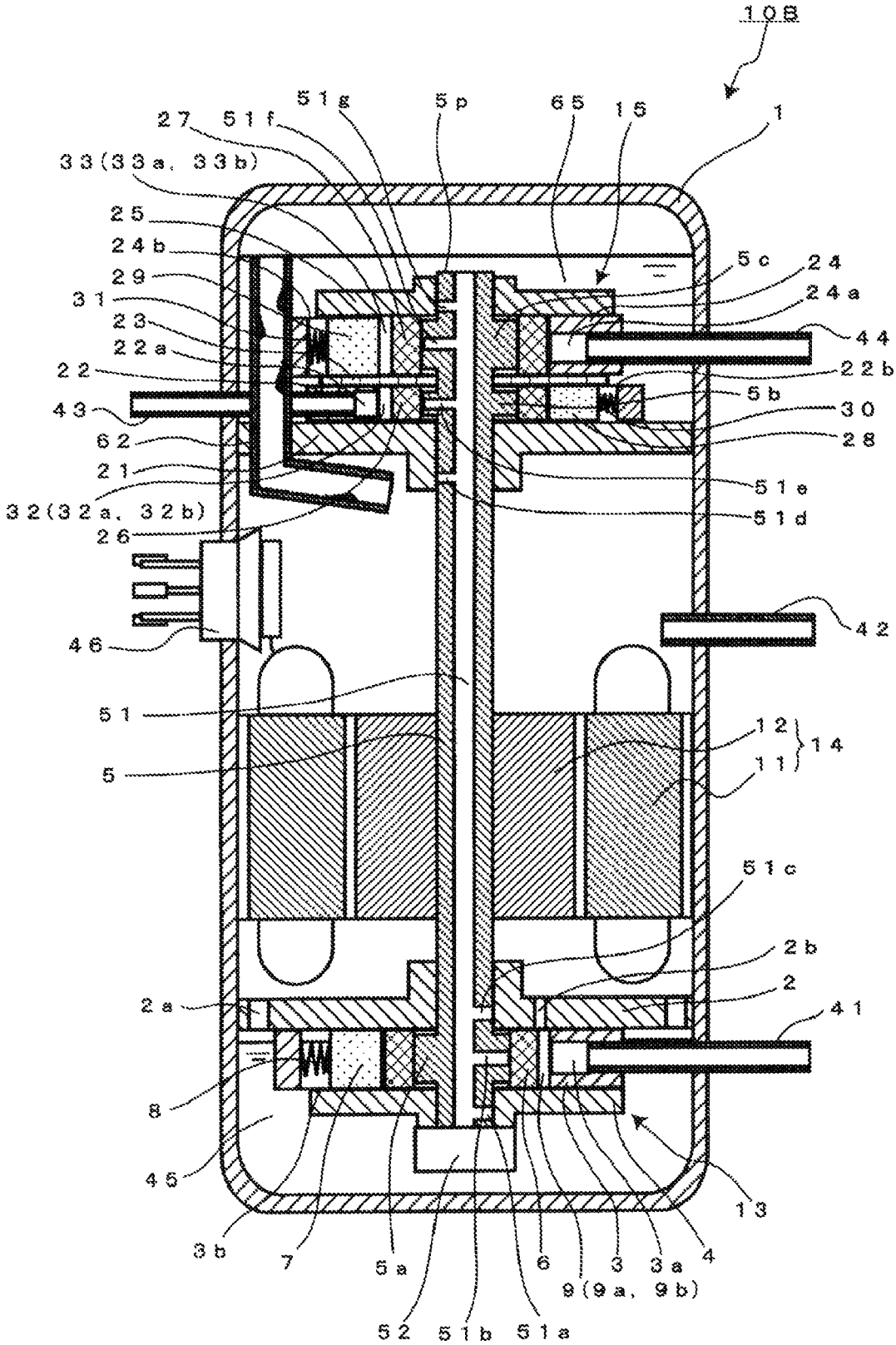
FIG. 2 is a vertical cross-sectional view illustrating a rotary-type fluid machine according to Embodiment 2 of the present invention.

A terminal 46 for supplying electric power to the motor 14 is fitted to the closed casing 1 in such a manner as to extend through the closed casing 1. The terminal 46 may be fitted to the topmost portion of the closed casing 1, as in the present embodiment 1, or may be fitted to between the rotary-type compression mechanism 13 and the rotary-type expansion mechanism 15, in other words, near the motor 14, as illustrated in FIG. 2, which will be described later.

A bottom portion of the closed casing 1 defines an oil reservoir 45 for holding oil for lubricating the rotary-type compression mechanism 13 and the rotary-type expansion mechanism 15. Because of the oil reservoir 45, a surrounding region around the rotary-type compression mechanism 13 is filled with the oil. On the other hand, the oil pumped up from the oil reservoir 45 is retained in the surrounding region around the rotary-type expansion mechanism 15 by an oil retention member 61, whereby an oil retaining portion 65 is formed in the surrounding region around the rotary-type expansion mechanism 15. Since both the rotary-type compression mechanism 13 and the rotary-type expansion mechanism 15 are immersed directly in oil, a sufficient amount of oil can be supplied to substantial parts, i.e., later-described vanes 7, 28, and 29, that need to be supplied with oil from outside of these mechanisms 13 and 15.

The rotary-type compression mechanism 13 includes an upper bearing member 2, a cylinder 3, a lower bearing member 4, a shaft 5, a roller 6, a vane 7, and a spring 8. The outer peripheral portion of the upper bearing member 2 is fixed to the closed casing 1. The cylinder 3 is fixed below the upper bearing member 2. The lower bearing member 4 is fixed below the cylinder 3. The shaft 5 is supported rotatably by the upper bearing member 2 and the lower bearing member 4, and it has eccentric portions 5*a*, 5*b*, and 5*c* arranged in that order from bottom. The roller 6 is fitted rotatably to the eccentric portion 5*a* of the shaft 5. The vane 7 is fitted to the cylinder 3. One end of the spring 8 is in contact with the cylinder 3 and the other end thereof is in contact with the vane 7 so that the vane 7 is pressed against the roller 6.

The upper bearing member 2 functions as a securing member for securing the rotary-type compression mechanism 13 to the closed casing 1. The outer peripheral portion of the upper bearing member 2 has an opening 2*a* and a discharge port 2*b*. The opening 2*a* is an oil return passage for allowing the oil flowing down from the upper portion of the closed casing 1 to return to the oil reservoir 45. The discharge port 2*b* is for discharging the refrigerant (working fluid) compressed in a working chamber 9 in the cylinder 3 to the interior of the closed casing 1. The cylinder 3 has a suction port 3*a* and a vane groove 3*b*. The suction port 3*a* allows the refrigerant to be compressed to be sucked into a working chamber 9. The vane groove 3*b* is for fitting the vane 7 so that it can move back and forth in a direction approaching, and a direction moving away from, the axis line of the shaft 5. The vane 7 fitted into the vane groove 3*b* is a partitioning member for partitioning the working chamber 9, which is formed between the cylinder 3 and the roller 6, into a suction side working chamber 9*a* and a discharge side working chamber 9*b*. As is seen from FIG. 1, the rear end of the vane groove 3*b* is exposed in the oil reservoir 45; therefore, oil can be supplied directly from the oil reservoir 45 to the sliding surfaces of the vane groove 3*b* and the vane 7. This feature is completely the same as in the rotary-type expansion mechanism 15, which is disposed in the upper portion.

It is also possible to provide a securing member for securing the rotary-type compression mechanism 13 to the closed casing 1, separately from the upper bearing member 2. In this case, an opening serving as the oil return passage is formed in the securing member. In the present specification, the shaft 5 is described to be a single member that is used for both the rotary-type compression mechanism 13 and the rotary-type expansion mechanism 15; however, the shaft 5 need not be a single member and may be constructed by two shafts that are coupled vertically either directly or via a coupler.

The motor 14 includes a stator 11 fixed to the closed casing 1 and a rotor 12 fixed to the shaft 5.

The rotary-type expansion mechanism 15 includes a lower bearing member 21, a first cylinder 22, an intermediate plate 23, a second cylinder 24, an upper bearing member 25, a first roller 26, a second roller 27, a first vane 28, a second vane 29, a first spring 30, and a second spring 31. The outer peripheral portion of the lower bearing member 21 is fixed to the closed casing 1. The first cylinder 22 is fixed to an upper portion of the lower bearing member 21. The intermediate plate 23 is fixed to an upper portion of the first cylinder 22. The second cylinder 24 is fixed to an upper portion of the intermediate plate 23. The upper bearing member 25 is fixed to an upper portion of the second cylinder 24 so as to support the shaft 5 rotatably. The first roller 26 is fitted rotatably to the eccentric portion 5*b* of the shaft 5. The second roller 27 is fitted rotatably to the eccentric portion 5*c* of the shaft 5. The first vane 28 is fitted to the first cylinder 22. The second vane 29 is fitted to the second cylinder 24. One end of the first spring 30 is in contact with the first cylinder 22 and the other end thereof is in contact with the first vane 28 so that the first vane 28 is pressed against the first roller 26. One end of the second spring 31 is in contact with the second cylinder 24 and the other end thereof is in contact with the second vane 29 so that the second vane 29 is pressed against the second roller 27. Thus, the rotary-type expansion mechanism 15 is constructed as what is called a multi-stage rotary-type fluid mechanism, which has a plurality of cylinders 22 and 24, a plurality of rollers 26 and 27, and a plurality of vanes 28 and 29.

The lower bearing member 21 has the function as a bearing for supporting the shaft 5 rotatably and the function as a support for supporting the entire rotary-type expansion mechanism 15. An opening 21*a* extending vertically through the lower bearing member 21 is formed in the outer peripheral portion of the lower bearing member 21. The opening 21*a* serves as an oil return passage for allowing the oil that has overflowed the oil retaining portion 65 to return to the oil reservoir 45. It is of course possible to provide a securing member for securing the rotary-type expansion mechanism 15 to the closed casing 1, separately from the lower bearing member 21. In this case, an opening serving as the oil return passage is formed in the securing member. It is also possible to provide a muffler between the lower bearing member 21 and the first cylinder 22 and/or between the upper bearing member 25 and the second cylinder 24, for reducing the pulsing of the refrigerant.

The first cylinder 22 has a suction port 22*a* and a first vane groove 22*b*. The suction port 22*a* allows the refrigerant to be expanded to be sucked into a working chamber 32. The vane groove 22*b* is for fitting the first vane 28 so that it can move back and forth in a direction approaching, and a direction moving away from, the axis of the shaft 5. The second cylinder 24 has a discharge port 24*a* and a second vane groove 24*b*. The discharge port 24*a* allows the refrigerant after expansion to be discharged from a working chamber 33. The second vane groove 24*b* is for fitting the second vane 29 so that the second vane 29 can move back and forth. The vanes 28, 29 are partitioning members for respectively partitioning the working chambers 32, 33, which are formed between the cylinders 22, 24 and the rollers 26, 27, respectively, into the suction side working chambers 32*a*, 33*a* and the discharge side working chambers 32*b*, 33*b*.

A suction pipe 41 for allowing the low-pressure refrigerant to be sucked from the outside of the closed casing 1 into the suction side working chamber 9*a* through the suction port 3*a* formed in the cylinder 3 extends through the closed casing 1 to be connected directly to the rotary-type compression mechanism 13. In addition, a discharge pipe 42 for allowing the high-pressure refrigerant discharged into the closed casing 1 to be discharged to the outside of the closed casing 1 from a location above the motor 14 is provided in such a manner as to extend through the closed casing 1. A suction pipe 43 and a discharge pipe 44 extend through the closed casing 1 to be connected directly to the rotary-type expansion mechanism 15 respectively. The suction pipe 43 allows the refrigerant before expansion to be sucked into the suction side working chamber 32*a* from the outside of the closed casing 1 through the suction port 22*a* formed in the first cylinder 22. The discharge pipe 44 allows the refrigerant after expansion to be discharged to the outside of the closed casing 1 from the discharge side working chamber 33*b* of the second cylinder 24 through the discharge port 24*a* formed in the second cylinder.

Thus, while the suction and discharge of the refrigerant from the outside of the closed casing 1 to the rotary-type expansion mechanism 15 are performed directly using the suction pipe 43 and the discharge pipe 44, the refrigerant compressed by the rotary-type compression mechanism 13 is discharged temporarily to the interior of the closed casing 1. Thereby, the pressure inside the closed casing 1 can be kept high at all times. Therefore, the pressure difference between the interior of the closed casing 1 and the interiors of the mechanisms 13 and 15 can be made large, and oil can be supplied to the mechanisms 13 and 15 easily. The oil contained in the refrigerant discharged from the rotary-type compression mechanism 13 is separated automatically from the refrigerant in the process in which the refrigerant passes through the interior of the closed casing 1. Moreover, since the lower bearing member 21 of the rotary-type expansion mechanism 15 serves to reduce violent current of the refrigerant existing above the lower bearing member 21, turbulent flow of the oil in the oil retaining portion 65 is prevented. As a result, the oil can be supplied stably to the vanes 28 and 29.

An oil supply passage 51 is formed inside the shaft 5 so as to extend axially straight. The oil supply passage 51 is for supplying the oil that is pumped up by an oil pump 52, provided at the lower end of the shaft 5, from the oil reservoir 45 to the rotary-type compression mechanism 13 and the rotary-type expansion mechanism 15. A plurality of oil supply holes 51*a*, 51*b*, 51*c*, 51*d*, 51*e*, 51*f*, 51*g*, for supplying the oil to the lower bearing member 4, the roller 6, and the upper bearing member 2 of the rotary-type compression mechanism 13 and to the lower bearing member 21, the first roller 26, the second roller 27, and the upper bearing member 25 of the rotary-type expansion mechanism 15, are formed so that they branch from the oil supply passage 51 radially outwardly.

An upper end face 5*p* of the shaft 5 is exposed, i.e., not covered by the upper bearing member 25. The oil supply passage 51 is open at the upper end face 5*p* of the shaft 5, exposed from the upper bearing member 25. Accordingly, excess oil pumped up by the oil pump 52, passes through the upper bearing member 25, reaches the upper end face 5*p* of the shaft 5, and overflows the oil supply passage 51. The oil that has overflowed is inhibited from immediately returning to the oil reservoir 45 by the oil retention member 61, and thereby the oil retaining portion 65 is formed. Such an oil retaining portion 65 is formed by the lower bearing member 21, which serves as the support for supporting the rotary-type expansion mechanism 15, and the oil retention member 61, which is disposed on the upper face of the lower bearing member 21 and between the rotary-type expansion mechanism 15 and the closed casing 1. The oil retention member 61 is open at the upper side that faces the terminal 46. Accordingly, the oil that has overflowed the oil retaining portion 65 flows through the gap between the oil retention member 61 and the closed casing 1, flows out under the lower bearing member 21 through the opening 21*a* formed in the outer peripheral portion of the lower bearing member 21, and returns to the oil reservoir 45.

The above-described configuration allows the oil supplied from the oil supply passage 51 of the shaft 5 and the oil that has finished lubricating the rotary-type expansion mechanism 15 to be held by the oil retention member 61 and retained in a surrounding region around the rotary-type expansion mechanism 15 temporarily. Therefore, the oil can be supplied from the outsides of the cylinders 22 and 24 to the sliding portions of the vanes 28 and 29 and the cylinders 22 and 24 stably.

As illustrated in FIG. 1, the oil retention member 61 includes a cylindrical trunk portion 61*a* that surrounds the rotary-type expansion mechanism 15 circumferentially, and a canopy 61*b* extending from the trunk portion 61*a* toward the center of the shaft 5. With the trunk portion 61*a*, the oil retaining portion 65 is formed over the entire circumferential part of the rotary-type expansion mechanism 15. Therefore, even when the positions of the first vane 28 and the second vane 29 are not aligned circumferentially, oil can be supplied uniformly and sufficiently to both of the vanes. Moreover, it becomes unnecessary to take the trouble of guiding the oil that has overflowed the oil supply passage 51 toward the inside of the oil retention member 61.

On the other hand, the canopy 61*b* contributes to retaining the oil and serves to prevent the oil from being lost entirely from the oil retaining portion 65 even when the rotary-type fluid machine 10A is tilted, for example, during transportation. This enables sufficient lubrication during the period from when the oil pump 52 starts until the supply of oil from the oil supply passage 51 begins, such as when starting up the rotary-type fluid machine 10A. Therefore, reliability of the rotary-type fluid machine 10A improves further.

It is preferable that the oil retaining portion 65 be formed so that the liquid level of the oil is positioned higher than the lower face of the vane that is positioned farthest from the oil pump 52, i.e., the second vane 29, in a condition in which the rotary-type fluid machine 10A is not in operation. By creating the condition in which the first vane 28 and the second vane 29 are immersed in the oil at all times, it is possible to avoid the problem of the lubrication deficiency occurring temporarily upon starting the operation.

Specifically, the upper end of the trunk portion 61*a* of the oil retention member 61 should be positioned higher than the upper face (upper end) of the second vane 29. In the present embodiment 1, it is preferable that the oil retaining portion 65 be formed so that the height of the trunk portion 61*a* is higher than the upper face of the upper bearing member 25, the canopy 61*b* covers the upper bearing member 25 partially, and the oil level is positioned at a height higher than the upper face of the second vane 29. This is desirable from the viewpoint of lubricating the second vane 29 and the second vane groove 24*b* because the oil can be supplied to the sliding surfaces from the entire gap between the second vane 29 and the second vane groove 24*b* with respect to the height direction. Of course, as long as the upper end of the oil retention member 61 is positioned higher than the lower face of the second vane 29, the liquid level in the oil retaining portion 65 also is kept higher than the lower face of the second vane 29. Then, the oil supplied from the vicinity of the lower face of the second vane 29 also spreads upwardly due to the pressure difference between the refrigerant in the closed casing 1 and the refrigerant in the working chamber 33. Therefore, the entire sliding surfaces of the second vane 29 and the second vane groove 24*b* can be lubricated, and reliability of the rotary-type fluid machine 10A can be ensured.

Figure 5A:
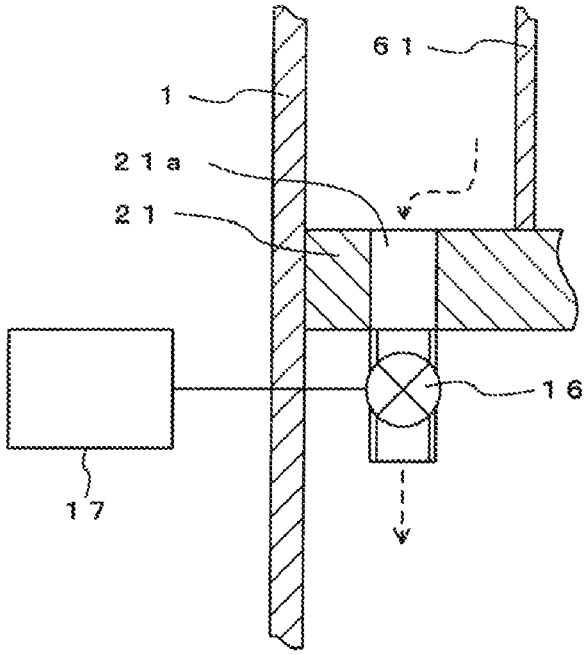
FIG. 5A is a partially enlarged view illustrating a modified example of the rotary-type fluid machine shown in FIG. 1, in which a valve is provided on the oil return passage.

As illustrated in the schematic view of FIG. 5A, a valve 16 may be provided on the opening 21*a* formed in the lower bearing member 21 as the oil return passage. The valve 16 can be switched by an external controller 17 between two states, an open state in which the oil that has overflowed the oil retaining portion 65 is permitted to pass through the oil return passage (the opening 21*a*) and a closed state in which the oil that has overflowed the oil retaining portion 65 is prohibited from passing therethrough.

When the valve 16 is controlled to be closed at the time point when a sufficient amount of oil is accumulated in the oil retaining portion 65, the closed casing 1 takes a form in which the interior thereof is divided into an upper portion and a lower portion, except for the oil supply passage 51 of the shaft 5, with the lower bearing member 21 being the boundary. Thus, the oil sent from the oil supply passage 51 does not flow into the upper side of the lower bearing member 21. In other words, after lubricating the bearing members 21 and 25 as well as the rollers 26 and 27, the excessive oil beyond that necessary for lubricating the vanes 28 and 29 does not flow toward the oil retaining portion 65 but flows to a region below the lower bearing member 21 along the shaft 5, returning to the oil reservoir 45. In this way, the amount of the oil sent from the oil reservoir 45 to the surrounding region around the rotary-type expansion mechanism 15 is reduced, and therefore, the heat exchange that takes place between the oil and the rotary-type expansion mechanism 15 can be minimized. Since the lower bearing member 21 is provided with an oil groove (not shown) for spreading the supplied oil over the entire lower bearing member 21, it is not particularly necessary to ensure a large clearance between the shaft 5 and the lower bearing member 21 for allowing excessive oil to return to the oil reservoir 45.

Figure 6A:
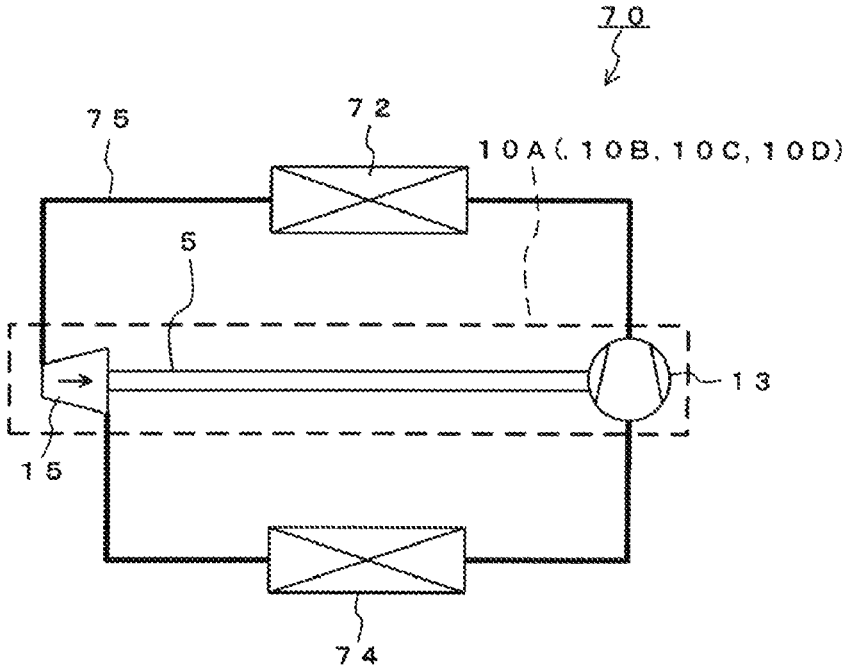
FIG. 6A is a block diagram illustrating a refrigeration cycle apparatus employing a rotary-type fluid machine as illustrated in FIGS. 1 to 4.
Figure 6B:
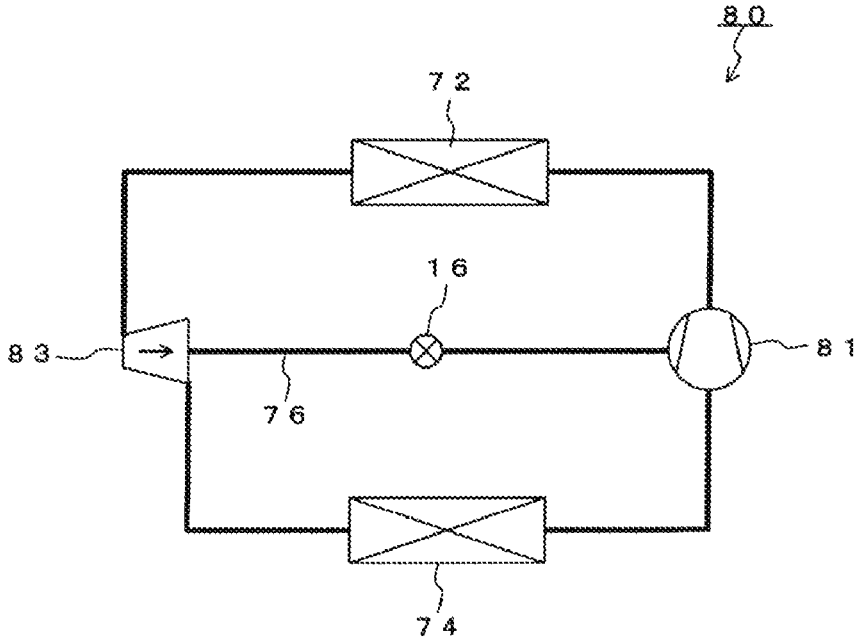
FIG. 6B is a block diagram illustrating a refrigeration cycle apparatus employing a compressor and/or an expander utilizing a rotary-type fluid machine as illustrated in FIGS. 1 to 4.

A refrigeration cycle apparatus 80 as illustrated in FIG. 6B, which employs an expander 83 having a dedicated closed casing and a compressor 81 having a dedicated closed casing, has been known. In the refrigeration cycle apparatus 80 with such a structure as well, oil mixes with the refrigerant and circulates through the refrigerant circuit. Therefore, a design consideration for making the amounts of oil in the compressor 81 and the expander 83 uniform is essential. Such a design consideration usually is achieved by connecting the oil reservoir of the compressor 81 and the oil reservoir of the expander 83 by an oil balancing pipe 76. A valve 16 for controlling the flow rate of the oil is provided at the oil balancing pipe 76. This valve 16 makes it possible to restrict free passage of the oil between the compressor 81 and the expander 83, preventing thermal short-circuiting between the compressor 81 and the expander 83 via the oil. Such a structure contributes to improvements in the coefficient of performance of the refrigeration cycle apparatus 80.

The rotary-type fluid machine 10A according to the present embodiment makes it possible to obtain substantially the same benefit as obtained in the refrigeration cycle apparatus 80, by providing the valve 16 on the oil return passage 21*a* (the opening 21*a*).

Next, the operation of the rotary-type fluid machine according to the present embodiment 1 will be described below.

When electric power is supplied from the terminal 46 to the motor 14, rotational power is generated between the stator 11 and the rotor 12, and the rotary-type compression mechanism 13 is driven by the shaft 5. In the rotary-type compression mechanism 13, two compression chambers 9 (9*a*, 9*b*) serving as the working chambers are formed by the cylinder 3, the vane 7, the roller 6, the upper bearing member 2, and the lower bearing member 4, and the volumes of the chambers are varied by the eccentric rotational motion of the roller 6 as a result of the rotation of the eccentric portion 5*a*. The volume of the compression chamber 9 communicating with the suction port 3*a* is increased as a result of the eccentric rotational motion of the roller 6, and a low-pressure refrigerant is sucked from the outside (the evaporator in the refrigeration cycle apparatus) through the suction pipe 41.

As the compression chamber 9 and the suction port 3*a* are disconnected and the volume is decreased as a result of the eccentric rotational motion of the roller 6, the refrigerant trapped in the compression chamber 9 is compressed. Then, when the pressure of the refrigerant in the compression chamber 9 exceeds the pressure of the refrigerant in the closed casing 1, a discharge valve (not shown) provided at the discharge port 2*b* opens. The high-pressure refrigerant is discharged into the closed casing 1. The discharged refrigerant passes through the discharge pipe 42 while cooling the motor 14, and then is discharged to the outside. The refrigerant discharged to the outside is cooled by the radiator in the refrigeration cycle apparatus (see FIG. 5A), is passed through the suction pipe 43, and is guided to the rotary-type expansion mechanism 15.

In the rotary-type expansion mechanism 15, two working chambers 32 (a first suction side working chamber 32*a* and a first discharge side working chamber 32*b*) are formed by the first cylinder 22, the first vane 28, the first roller 26, the lower bearing member 21, and the intermediate plate 23, and two working chambers 33 (a second suction side working chamber 33*a* and a second discharge side working chamber 33*b*) are formed by the second cylinder 24, the second vane 29, the second roller 27, the upper bearing member 25, and the intermediate plate 23. Then, the first discharge side working chamber 32*b*, which is inhibited from communicating with the suction port 22*a* by the first roller 26, and the second suction side working chamber 33*a*, which is inhibited from communicating with the discharge port 24*a* by the second roller 27, are connected by a through hole (not shown) formed in the intermediate plate 23, forming a single expansion chamber. Here, the through hole of the intermediate plate 23 is positioned opposite the suction port 22*a* with the first vane 28 interposed therebetween when viewed from the working chamber 32 side and opposite the discharge port 24*a* with the second vane 29 interposed therebetween when viewed from the working chamber 33 side.

When the high-pressure refrigerant flows in from the suction port 22*a*, the refrigerant pushes the first roller 26 and rotates the shaft 5, so the volume of the first suction side working chamber 32*a* communicating with the suction port 22*a* increases. As a result of the eccentric rotational motion of the first roller 26, the first suction side working chamber 32*a* is disconnected from the suction port 22*a*, and the chamber 32*a* changes into the first discharge side working chamber 32*b* communicating with the through hole of the intermediate plate 23. As the shaft 5 rotates, the volume of the first discharge side working chamber 32*b* starts to decrease but the volume of the second suction side working chamber 33*a*, which has a greater cylinder volume, starts to increase. The refrigerant moves from the first discharge side working chamber 32*b* to the second suction side working chamber 33*a* and at the same time it expands. As the shaft 5 rotates further, the second suction side working chamber 33*a* is disconnected from the through hole of the intermediate plate 23, and the second suction side working chamber 33*a* changes into the second discharge side working chamber 33*b*. The second discharge side working chamber 33*b* communicates with the discharge port 24*a* and the volume of the second discharge side working chamber 33*b* decreases, so the refrigerant expanded to a predetermined pressure is discharged to the outside of the closed casing 1 through the discharge pipe 44. The refrigerant discharged to the outside is heated by the evaporator in the refrigeration cycle apparatus (see FIG. 6A) and is returned to the suction pipe 41.

Next, lubrication in the rotary-type fluid machine 10A according to the present embodiment 1 will be described below.

As the shaft 5 is rotated by the motor 14, the oil pump 52 provided at the lower end of the shaft 5 pumps up the oil from the oil reservoir 45 to the oil supply passage 51. The pumped-up oil is supplied to the lower bearing member 4, the roller 6, the upper bearing member 2, the lower bearing member 21, the first roller 26, the second roller 27, and the upper bearing member 25, through the oil supply holes 51*a*, 51*b*, 51*c*, 51*d*, 51*e*, 51*f*, and 51*g*, to lubricate the sliding portions. Since the surrounding portion around the rotary-type compression mechanism 13 is filled with the oil in the oil reservoir 45, the gap between the vane 7 and the vane groove 3*b* is supplied with the oil directly from the oil reservoir 45.

On the other hand, the oil that has overflowed the upper end of the oil supply passage 51 is retained temporarily in a surrounding region around the rotary-type expansion mechanism 15 by the oil retention member 61. The oil retained by the oil retention member 61 is supplied directly to the sliding portions between the first vane 28 and the first vane groove 22*b* and the sliding portions between the second vane 29 and the second vane groove 24*b*.

Figure 7:
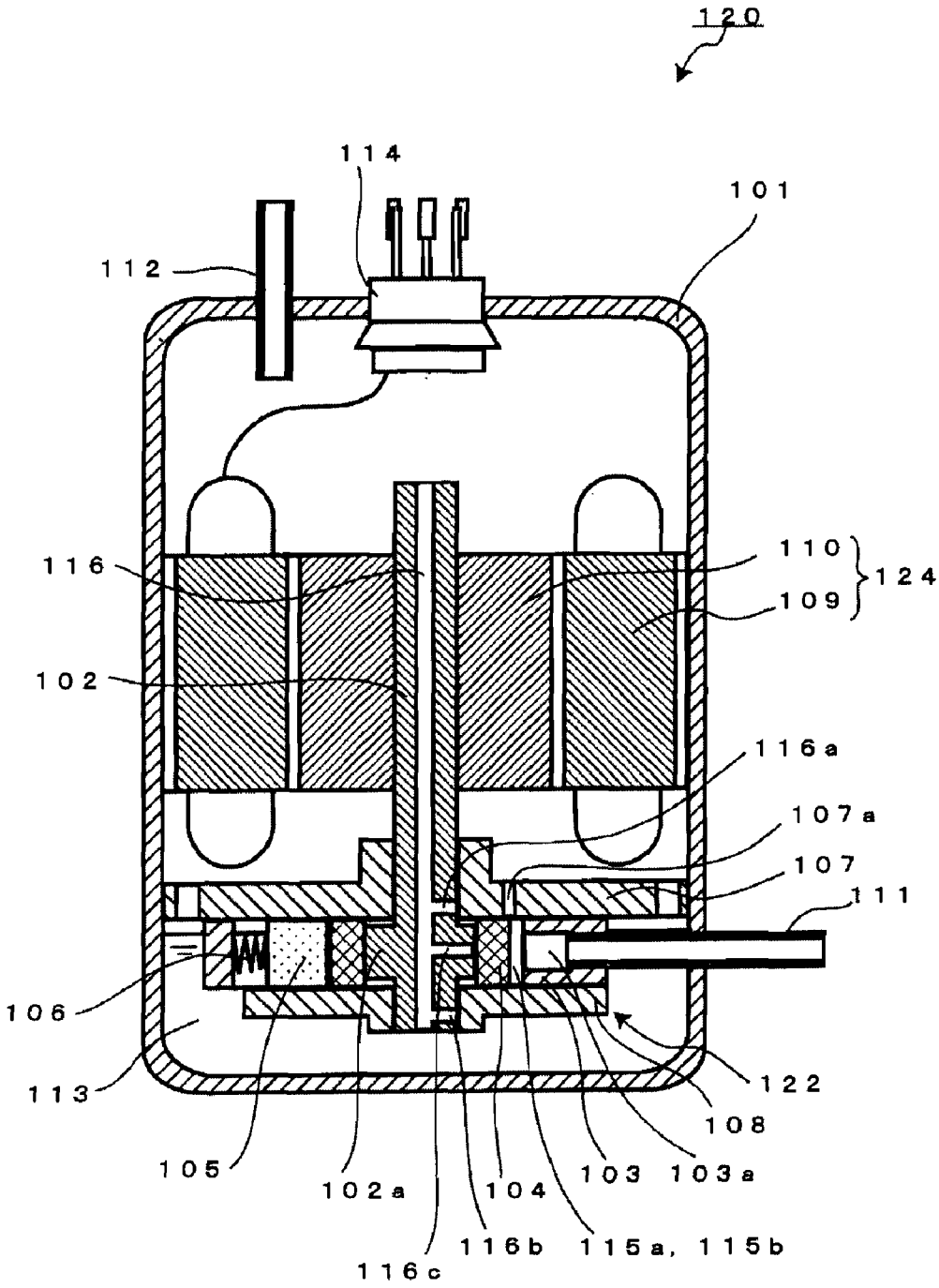
FIG. 7 is a vertical cross-sectional view illustrating a conventional rotary-type compressor.
Figure 8:
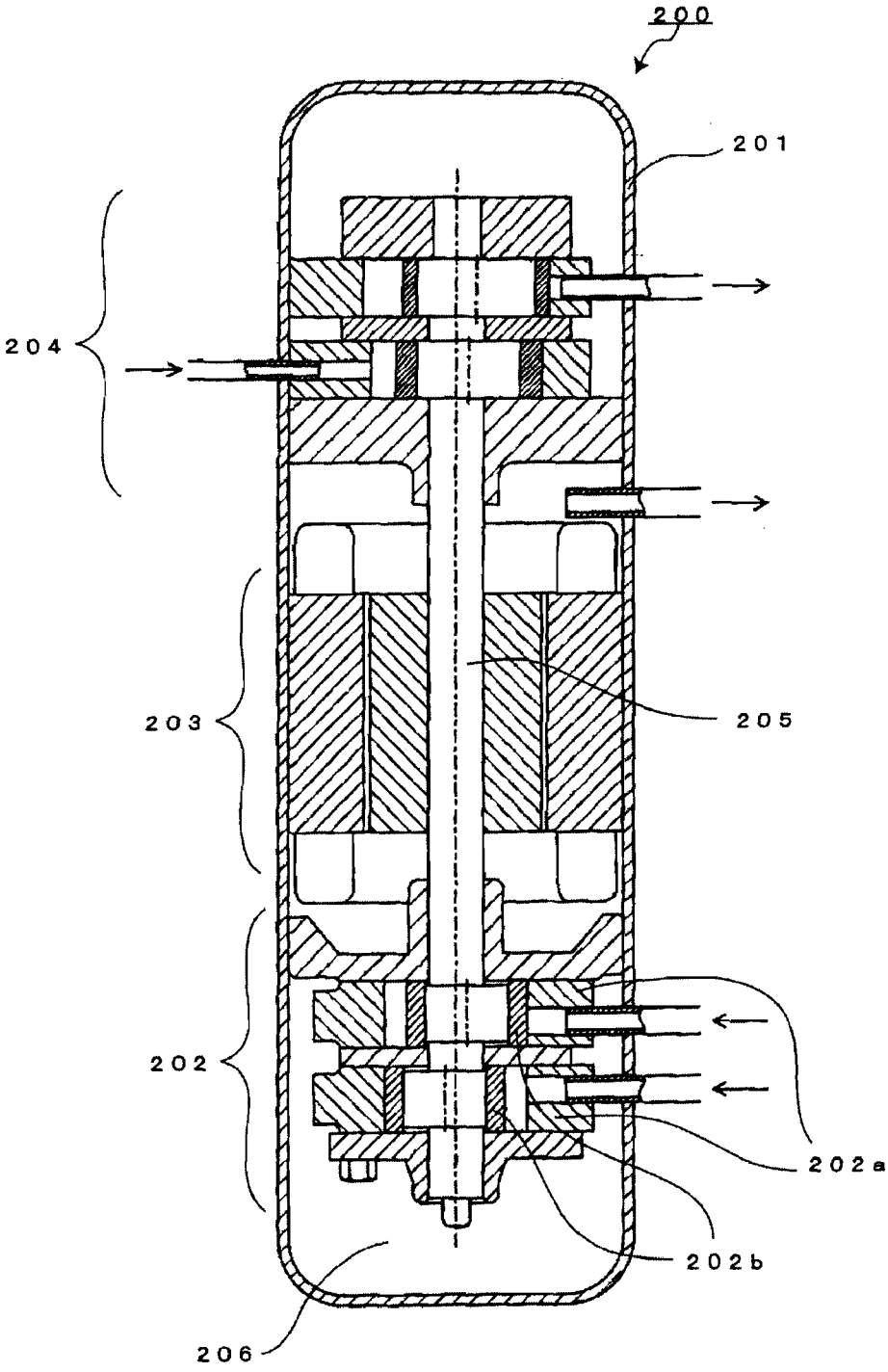
FIG. 8 is a vertical cross-sectional view illustrating a conventional fluid machine in which a rotary-type compression mechanism and a rotary-type expansion mechanism are integrated.

By providing the oil retention member 61, lubrication to the first vane 28 and the second vane 29 of the rotary-type expansion mechanism 15, which is provided away from the oil reservoir 45, can be achieved stably in a simple manner, as in the case of the conventional rotary-type compressor (FIG. 7), and damages to the sliding portions such as seizure can be prevented. Therefore, it becomes possible to provide a rotary-type fluid mechanism (the rotary-type expansion mechanism 15 in the present embodiment) in an upper portion of the closed casing 1 without providing a complicated oil supply mechanism. Moreover, since the surrounding region around the rotary-type expansion mechanism 15 is filled with oil, leakage of the refrigerant from the gaps, for example around the first vane 28 and the second vane 29, is reduced. As a result, the volume efficiency of the rotary-type expansion mechanism 15 improves, increasing the efficiency.

Embodiment 2

FIG. 2 is a vertical cross-sectional view illustrating a rotary-type fluid machine 10B according to Embodiment 2 of the present invention. In FIG. 2, the same parts as illustrated in FIG. 1 are denoted by the same reference numerals, and the descriptions thereof will be omitted.

The present embodiment 2 is different from Embodiment 1 in that the opening 21*a* in the lower bearing member 21 and the oil retention member 61 are eliminated and an overflow pipe 62 is attached to the lower bearing member 21 in Embodiment 2. The upper opening of the overflow pipe 62 is at a position higher than the lower face of the second vane 29. The overflow pipe 62, the closed casing 1, and the lower bearing member 21 together form the oil retaining portion 65. The overflow pipe 62 is disposed so as to vertically extend through the lower bearing member 21, which supports the rotary-type expansion mechanism 15, so that it allows excessive oil to flow down to a region below the lower bearing member 21 when the liquid level of the oil retained in the surrounding region around the rotary-type expansion mechanism 15 exceeds a predetermined height. That is, the overflow pipe 62 is an oil return passage for allowing the oil that has overflowed the oil retaining portion 65 to return to the oil reservoir 45.

The oil supplied from the oil supply passage 51 of the shaft 5 and the oil that has lubricated the rotary-type expansion mechanism 15 are retained temporarily around the rotary-type expansion mechanism 15 that is lower than the upper opening of the overflow pipe 62. As a result, it is possible to supply oil from the outside of the cylinders 22 and 24 to the sliding surfaces between the vanes 28, 29 and the vane grooves 22*b*, 24*b* stably. Moreover, by providing the overflow pipe 62 nearer to the rotary-type expansion mechanism 15 than the inner wall of the closed casing 1, a portion of the oil that does not reach the opening of the overflow pipe 62 remains in the oil retaining portion 65 even when the rotary-type fluid machine 10B is tilted, for example, during transportation. This enables sufficient lubrication during the period until the oil pump 52 starts and the supply of oil from the oil supply passage 51 begins, such as when starting up the rotary-type fluid machine 10B. Therefore, reliability of the rotary-type fluid machine 10B improves further.

The overflow pipe 62 is bent at a portion below the lower bearing member 21. The overflow pipe 62 that is lower than the lower bearing member 21 extends toward the center of the shaft 5 while ensuring an inclination for returning the oil. In this way, the swirling flow of the refrigerant produced due to a high-speed revolution of the motor 14 via the overflow pipe 62 does not easily affect the space above the oil retaining portion 65, and the oil level in the oil retaining portion 65 stabilizes, leading to stabilization of the oil supply to the vanes 28 and 29.

Moreover, since the lower portion of the overflow pipe 62 is bent inwardly of the closed casing 1, the lower bent portion of the overflow pipe 62 contributes to retaining the oil, and the oil in the oil retaining portion 65 does not easily flow to the oil reservoir 45 side even when the rotary-type fluid machine 10B is tilted, for example, during transportation. In other words, the oil in the oil retaining portion 65 is not emptied entirely. This enables lubrication during the period from when the oil pump 52 starts until the supply of oil from the oil supply passage 51 begins, such as when starting up the rotary-type fluid machine 10B. Therefore, reliability of the rotary-type fluid machine 10B improves further.

It is also preferable that the inner diameter of the overflow pipe 62 be greater than the inner diameter of the oil supply passage 51. This makes it possible to return the oil that has reached the upper opening of the overflow pipe 62 to the oil reservoir 45 smoothly. It should be noted that it is possible to provide a plurality of such overflow pipes 62. In this case, it is preferable that the total cross-sectional area of the plurality of overflow pipes 62 be greater than the cross-sectional area of the oil supply passage 51.

Figure 5B:
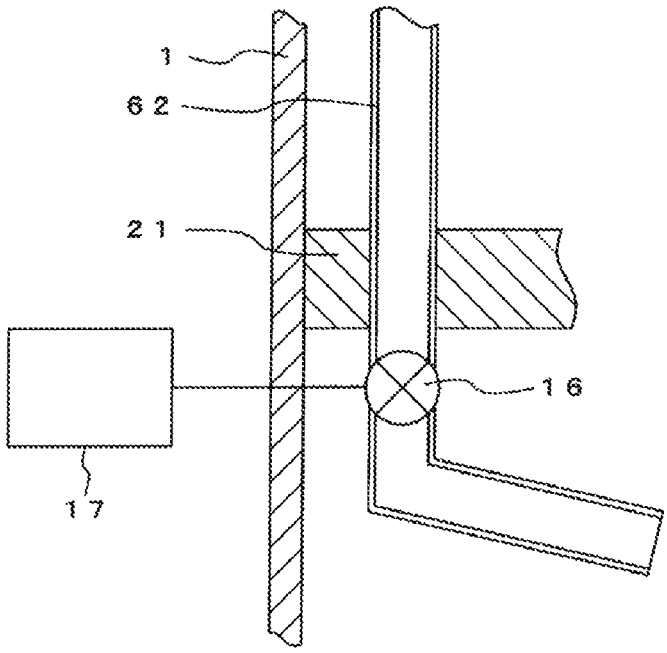
FIG. 5B is a partially enlarged view illustrating a modified example of the rotary-type fluid machine shown in FIG. 2, in which a valve is provided on the oil return passage.

Furthermore, as illustrated in FIG. 5B, it is possible to provide the valve 16 at a portion of the overflow pipe 62 that is lower than the lower bearing member 21, as described with reference to FIG. 5A. In this case, heat exchange between the oil and the rotary-type expansion mechanism 15 can be prevented for the reason stated previously. The position of the valve 16 is not particularly limited, and may be at an end of the overflow pipe 62 or at a halfway point thereof as illustrated in FIG. 5B.

As described above, in Embodiment 2 of the present invention, the oil retaining portion 65 is formed by the closed casing 1, the lower bearing member 21, and the overflow pipe 62. The oil that has overflowed the upper end of the oil supply passage 51 is retained in the surrounding region around the rotary-type expansion mechanism 15 temporarily. The retained oil is supplied directly to the sliding portions between the first vane 28 and the first vane groove 22*b* and between the second vane 29 and the second vane groove 24*b*. Then, the oil that has reached the upper opening of the overflow pipe 62 returns to the oil reservoir 45 through the overflow pipe 62.

Thus, by providing the overflow pipe 62, lubrication to the first vane 28 and the second vane 29 of the rotary-type expansion mechanism 15, which are provided away from the oil reservoir 45, can be achieved stably in a simple manner, as in the case of the conventional rotary-type compressor (FIG. 7), and damages to the sliding portions such as seizure can be prevented. Therefore, it becomes possible to provide a rotary-type fluid mechanism (the rotary-type expansion mechanism 15 in the present embodiment) in an upper portion of the closed casing 1 without providing a complicated oil supply mechanism. Moreover, since the surrounding region around the rotary-type expansion mechanism 15 is filled with oil, leakage of the refrigerant from the gaps, for example, around the first vane 28 and the second vane 29 is reduced. As a result, the volume efficiency of the rotary-type expansion mechanism 15 improves, increasing the efficiency.

Furthermore, in the rotary-type fluid machine according to Embodiment 2 of the present invention, shown in FIG. 2, the upper opening of the overflow pipe 62 is positioned higher than the upper face of the second vane 29. Thereby, the oil retaining portion 65 is formed so that the oil level is positioned at a height higher than the upper face of the second vane 29. This is desirable from the viewpoint of lubricating the second vane 29 and the second vane groove 24*b* since the oil can be supplied to the sliding surfaces from the entire gap between the second vane 29 and the second vane groove 24*b* with respect to the height direction. Of course, as long as the upper end of the overflow pipe 62 is positioned higher than the lower face of the second vane 29, the oil level in the oil retaining portion 65 is also kept higher than the lower face of the second vane 29. Then, the oil supplied from the vicinity of the lower face of the second vane 29 also spreads upwardly due to the pressure difference between the refrigerant in the closed casing 1 and the refrigerant in the working chamber 33. Therefore, the entire sliding surfaces of the second vane 29 and the second vane groove 24*b* can be lubricated, and reliability of the rotary-type fluid machine 10B can be ensured.

It should be noted that the same advantageous effects can be obtained by employing the configuration in which an opening is formed in the lower bearing member 21 and the overflow pipe is installed only in the region thereabove.

Embodiment 3

Figure 3:
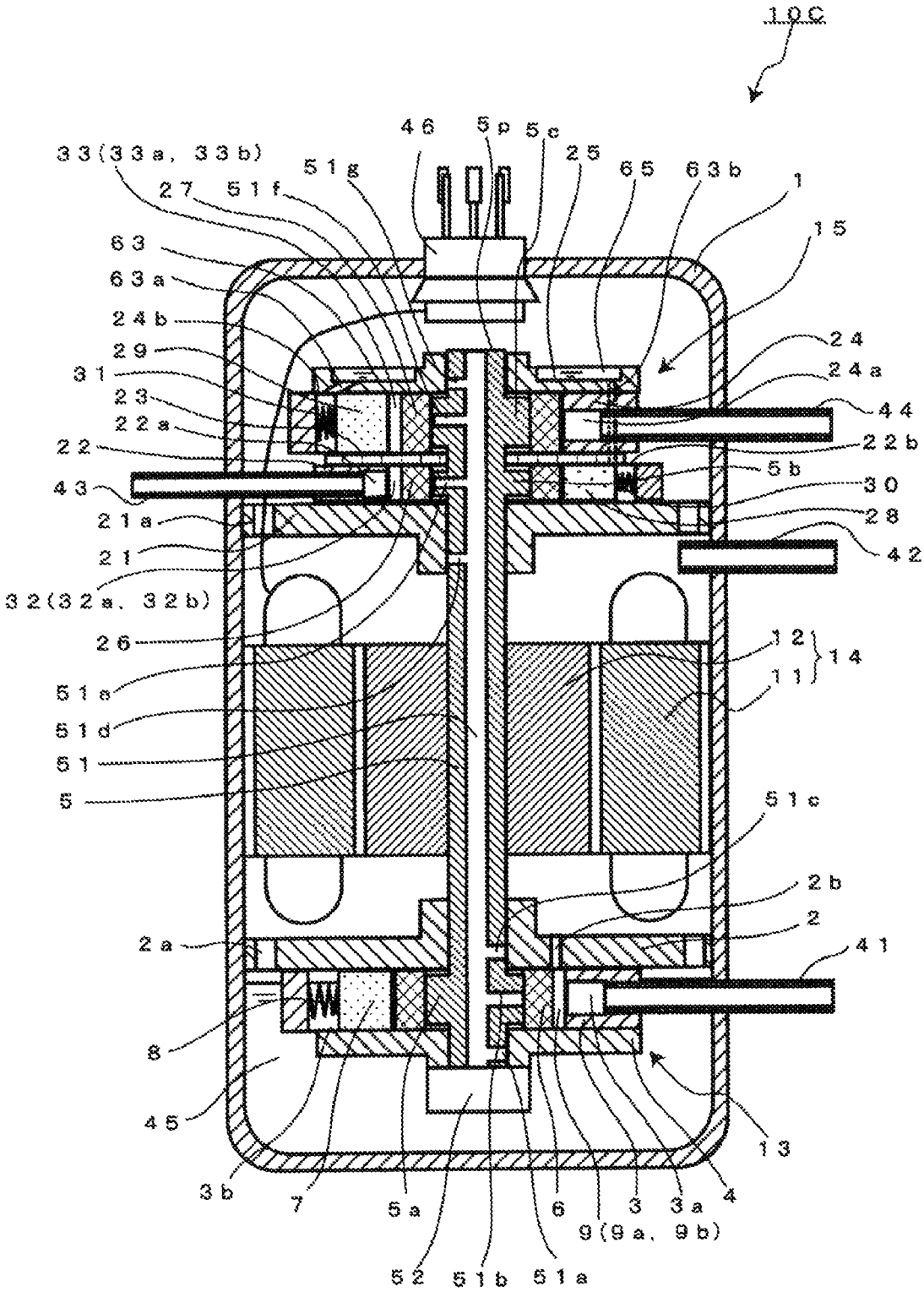
FIG. 3 is a vertical cross-sectional view illustrating a rotary-type fluid machine according to Embodiment 3 of the present invention.

FIG. 3 is a vertical cross-sectional view illustrating a rotary-type fluid machine 10C according to Embodiment 3 of the present invention. In FIG. 3, the same parts as illustrated in FIG. 1 are denoted by the same reference numerals, and the descriptions thereof will be omitted.

The present embodiment 3 is different from Embodiment 1 in that the oil retention member 61 is eliminated, an annular recessed portion 63 is provided in the upper face of the upper bearing member 25, and oil guide passages 63*a* and 63*b* extending from the bottom face of the recessed portion 63 toward the second vane groove 24*b* and the first vane groove 22*b*, respectively, are provided.

As described above, in Embodiment 3 of the present invention, the oil retaining portion 65 is formed by the recessed portion 63, and the oil that has overflowed the upper end of the oil supply passage 51 is retained by the recessed portion 63 temporarily. The oil retained in the recessed portion 63 is supplied to the sliding portions between the first vane 28 and the first vane groove 22*b* and between the second vane 29 and the second vane groove 24*b* by the oil guide passages 63*a* and 63*b*. Then, the oil that has reached the upper end of the recessed portion 63 overflows the recessed portion 63 and returns to the oil reservoir 45 through the opening 21*a* of the lower bearing member 21.

Thus, by providing the recessed portion 63 and the oil guide passages 63*a* and 63*b*, lubrication to the first vane 28 and the second vane 29 of the rotary-type expansion mechanism 15, which is provided away from the oil reservoir 45, can be achieved stably, and damage to the sliding portions such as seizure can be prevented. Therefore, it becomes possible to provide a rotary-type fluid mechanism (the rotary-type expansion mechanism 15 in the present embodiment) in an upper portion of the closed casing 1 without providing a complicated oil supply mechanism. Moreover, since oil is supplied to the gaps between the first vane 28 and the first vane groove 22*b* and between the second vane 29 and the second vane groove 24*b*, leakage of the refrigerant from the gaps around the first vane 28 and the second vane 29 reduces. As a result, the volume efficiency of the rotary-type expansion mechanism 15 improves, increasing the efficiency.

Furthermore, since the oil retaining portion 65 can be formed easily by a cutting process carried out on the upper bearing member 25 or merely adding the recessed portion to the mold, a cost increase of the rotary-type fluid machine 10C does not tend to arise.

What is more, in the rotary-type fluid machine according to Embodiment 3 of the present invention shown in FIG. 3, the recessed portion 63 is positioned higher than the upper face of the vane 29, so the oil retaining portion 65 is formed so that the oil level is positioned at a height higher than the upper face of the second vane 29. This is desirable from the viewpoint of lubricating the vanes 28, 29 and the vane grooves 22*b*, 24*b* since the oil can be supplied to the sliding surfaces from the entire gaps between the second vane 29 and the second vane groove 24*b* and between the first vane 28 and the first vane groove 22*b* by the oil guide passages 63*a* and 63*b* with respect to the height direction. Of course, when the oil guide passages 63*a* and 63*b* and the vane grooves 29 and 28 are connected at any locations, the oil spreads due to the pressure difference between the refrigerant in the closed casing 1 and the refrigerant in the working chamber 32 and the working chamber 33. Therefore, the entire sliding surfaces of the second vane 29 and the second vane groove 24*b* and of the first vane 28 and the first vane groove 22*b* can be lubricated, and reliability of the rotary-type fluid machine 10C can be ensured.

In the present embodiment 3, the intermediate plate 23 does not cover the upper end face of the first vane groove 22*b* and the lower end face of the second vane groove 24*b* entirely as depicted in FIG. 3; however, it is possible that the intermediate plate 23 cover the upper end face of the first vane groove 22*b* and the lower end face of the second vane groove 24*b* entirely. When the intermediate plate 23 covers the upper end face of the first vane groove 22*b* and the lower end face of the second vane groove 24*b* entirely, the oil supplied from the oil guide passage 63*b* and the oil guide passage 63*a* is retained in the first vane groove 22*b* and the second vane groove 24*b*. As a result, the oil can be supplied to the sliding surfaces from the entire gaps between the second vane 29 and the second vane groove 24*b* and between the first vane 28 and the first vane groove 22*b* with respect to the height direction. This is desirable from the viewpoint of lubrication to the second vane 29 and the second vane groove 24*b* and to the first vane 28 and the first vane groove 22*b*.

In addition, although the oil retaining portion 65 is formed by the recessed portion 63 in the present embodiment 3, it is also possible to form the oil retaining portion 65 by, for example, a groove for guiding the oil that has overflowed the upper end of the oil supply passage 51 to the oil guide passages 63*a* and 63*b*. Moreover, although the recessed portion 63 is provided in the upper face of the upper bearing member 25 in the present embodiment 3, there may be cases in which the part positioned higher than the lower face of the second vane 29, in other word, the part positioned at the topmost position in the rotary-type expansion mechanism 15, does not have the bearing function. For example, a muffler provided between the upper bearing member 25 and the second cylinder 24 for reducing noise or pulsing of the refrigerant is such a part. It is possible to provide the recessed portion 63 in the upper face of such a muffler so that the oil supplied from the oil supply passage 51 can be retained therein.

Embodiment 4

Figure 4:
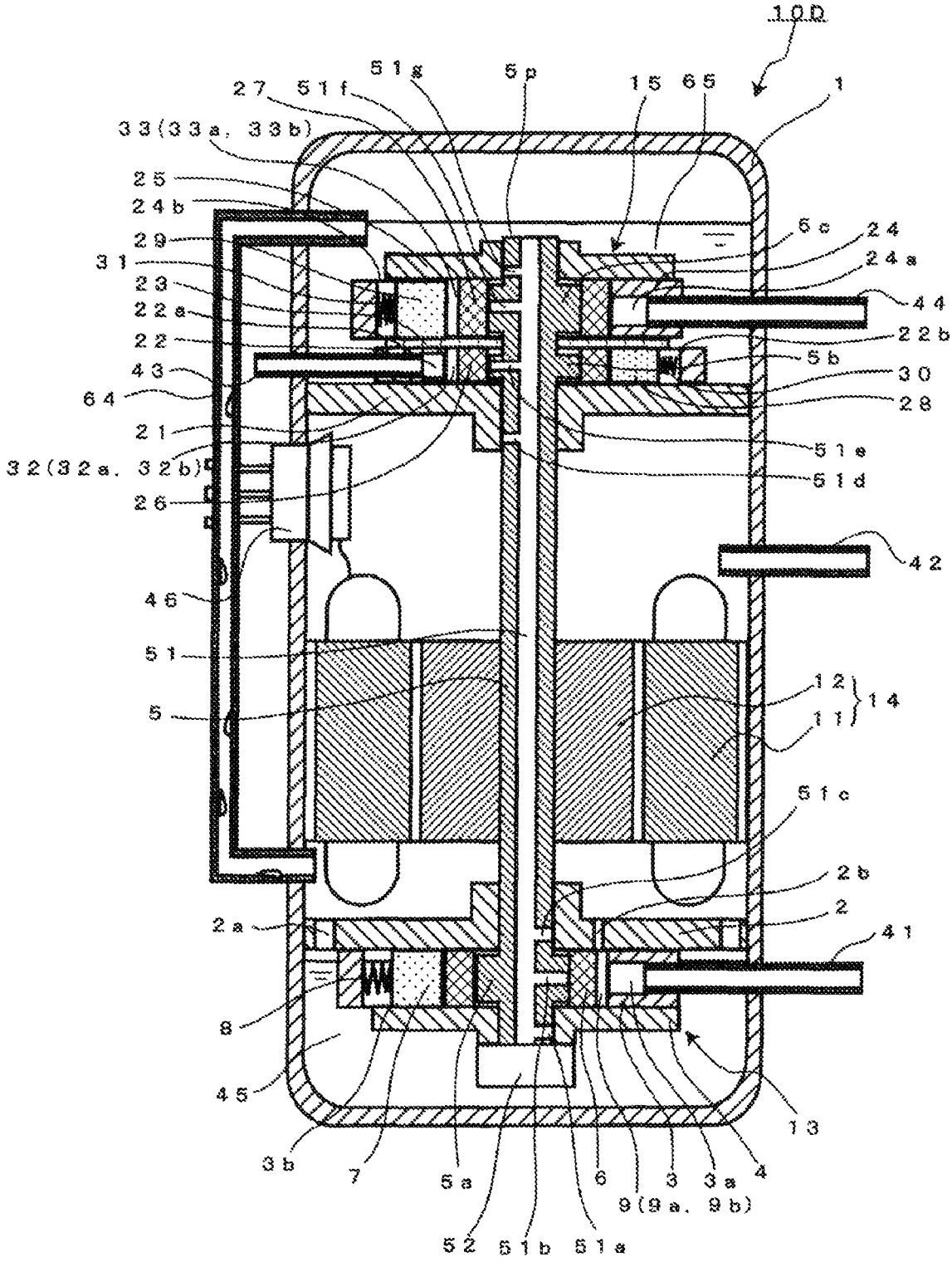
FIG. 4 is a vertical cross-sectional view illustrating a rotary-type fluid machine according to Embodiment 4 of the present invention.

FIG. 4 is a vertical cross-sectional view illustrating a rotary-type fluid machine 10D according to Embodiment 4 of the present invention. In FIG. 4, the same parts as illustrated in FIG. 1 are denoted by the same reference numerals, and the descriptions thereof will be omitted.

The present embodiment 4 is different from Embodiment 1 in that the opening 21*a* in the lower bearing member 21 and the oil retention member 61 are eliminated, and an oil return pipe 64 is provided instead. The oil return pipe 64 is fitted to the closed casing 1 so that one end thereof opens toward the interior of the closed casing 1 at a position higher than the lower face of the second vane 29, and the other end thereof opens toward the interior of the closed casing 1 at a position lower than the lower bearing member 21. More specifically, the other end of the oil return pipe 64 shown in FIG. 4 is connected to the interior of the closed casing 1 at a position lower than the motor 14.

As described above, in Embodiment 4 of the present invention, the oil retaining portion 65 is formed by the closed casing 1, the lower bearing member 21, and the oil return pipe 64, and the oil that has overflowed the upper end of the oil supply passage 51 is retained in the surrounding region around the rotary-type expansion mechanism 15 temporarily. The retained oil is supplied directly to the sliding portions between the first vane 28 and the first vane groove 22*b* and between the second vane 29 and the second vane groove 24*b*. Then, the oil that has reached the upper opening of the oil return pipe 64 is guided through the oil return pipe 64 to a region below the motor 14, and returns to the oil reservoir 45.

Thus, by providing the oil return pipe 64, lubrication to the first vane 28 and the second vane 29 of the rotary-type expansion mechanism 15, which is provided away from the oil reservoir 45, can be achieved stably in a simple manner, as in the case of the conventional rotary-type compressor (FIG. 7), and damage to the sliding portions such as seizure can be prevented. Therefore, it becomes possible to provide a rotary-type fluid mechanism (the rotary-type expansion mechanism in the present embodiment) in an upper portion of the closed casing 1 without providing a complicated oil supply mechanism. Moreover, since the surrounding region around the rotary-type expansion mechanism 15 is filled with oil, leakage of the refrigerant from the gaps, for example, around the first vane 28 and the second vane 29 is reduced. As a result, the volume efficiency of the rotary-type expansion mechanism 15 improves, increasing the efficiency.

In addition, the upper portion of the oil return pipe 64 extends through the closed casing 1 to the interior thereof and opens at a position slightly extending toward the axial line of the shaft 5. As a result, the portion extending inside the closed casing 1 contributes to retaining the oil and serves to prevent the oil from being lost entirely from the oil retaining portion 65 even when the rotary-type fluid machine is tilted, for example, during transportation. This enables sufficient lubrication during the period from when the oil pump 52 starts until the supply of oil from the oil supply passage 51 begins, such as when starting up the rotary-type fluid machine 10D. Therefore, reliability of the rotary-type fluid machine 10D improves further.

Furthermore, it is preferable that the inner diameter of the oil return pipe 64 be greater than the inner diameter of the oil supply passage 51. This makes it possible to return the oil that has reached the upper opening of the oil return pipe 64 to the oil reservoir 45 smoothly. Of course, it is possible to provide a plurality of the oil return pipes 64, as described in Embodiment 2.

What is more, the oil retained temporarily in the oil retaining portion 65 can be returned to a region below the motor 14, and therefore, the oil can be prevented from being micronized by the swirling flow of the refrigerant associated with the rotation of the rotor 12 of the motor 14. Thus, the oil can be returned to the oil reservoir 45 easily, and the oil level in the oil reservoir 45 can be kept stably. Accordingly, stable oil supply to the rotary-type expansion mechanism 15 can be realized by the oil pump 52, and reliability of the rotary-type fluid machine 10D can be improved.

Furthermore, in the rotary-type fluid machine according to Embodiment 4 of the present invention shown in FIG. 4, the upper opening of the oil return pipe 64 is positioned higher than the upper face of the second vane 29. Thereby, the oil retaining portion 65 is formed so that the oil level is positioned at a height higher than the upper face of the second vane 29. This is desirable from the viewpoint of lubricating the second vane 29 and the second vane groove 24*b* since the oil can be supplied to the sliding surfaces from the entire gap between the second vane 29 and the second vane groove 24*b* with respect to the height direction. Of course, when the upper opening of the oil return pipe 64 is positioned higher than the lower face of the second vane 29, the oil supplied from the vicinity of the lower face of the second vane 29 also spreads upwardly due to the pressure difference between the refrigerant in the closed casing 1 and the refrigerant in the working chamber 33. Therefore, the entire sliding surfaces of the second vane 29 and the second vane groove 24*b* can be lubricated, and reliability of the rotary-type fluid machine 10D can be ensured.

Further, the valve 16 as illustrated referring to FIG. 5B may be provided in the oil return pipe 64.

The foregoing embodiments described the fluid machines 10A to 10D of the following type (what is called expander-compressor units). In each of the fluid machines, the rotary-type expansion mechanism 15 serving as a first fluid mechanism is disposed in an upper portion of the closed casing 1; the rotary-type compression mechanism 13 serving as a second fluid mechanism is disposed in a lower portion of the closed casing 1 so as to be immersed directly in the oil held in the oil reservoir 45; and the rotary-type expansion mechanism 15 and the rotary-type compression mechanism 13 are coupled to each other by the shaft 5. It should be noted, however, that the present invention is not limited to this. For example, it is possible to provide a rotary-type expansion mechanism in a lower portion of the closed casing and a rotary-type compression mechanism in an upper portion of the closed casing. Both of them may be rotary-type compression mechanisms, or conversely, both may be rotary-type expansion mechanisms. The present invention is effective at least in the cases in which a rotary-type fluid mechanism is provided away from the oil reservoir. Therefore, the present invention may be applied suitably to a rotary compressor in which a rotary-type compression mechanism is provided in an upper portion of the closed casing as well as to a rotary expander in which a rotary-type expansion mechanism is provided in an upper portion of the closed casing.

Application Examples of the Rotary-Type Fluid Machine

Recently, further energy-saving measures have been demanded for the refrigeration cycle system in electric appliances, and it is necessary to use an expansion mechanism in place of an expansion valve. The present invention is most suitable for constructing an integrated-type fluid machine in which a rotary compressor and a rotary-type expansion mechanism are coupled to each other by a shaft and they are disposed in a single closed casing.

Specifically, the rotary-type fluid machines 10A to 10D illustrated referring to FIGS. 1 to 4 may be applied to a refrigeration cycle apparatus (synonymous with a refrigeration cycle system) for heating or cooling an object such as air and water. As illustrated in FIG. 6A, a refrigeration cycle apparatus 70 includes: a compression mechanism 13 for compressing a refrigerant; a radiator 72 for cooling the refrigerant compressed by the compressor 13; an expansion mechanism 15 for expanding the refrigerant that has dissipated heat at the radiator 72; and an evaporator 74 for evaporating the refrigerant expanded by the expansion mechanism 15. The compression mechanism 13, the radiator 72, the expansion mechanism 15, and the evaporator 74 are connected by pipes 75, whereby a refrigerant circuit is formed. The compression mechanism 13 and the expansion mechanism 15 are parts of the rotary-type fluid machines 10A to 10D respectively illustrated with FIGS. 1 to 4. The pipes 75 include the suction pipes 41, 43 and the discharge pipes 42, 44 shown in FIGS. 1 to 4. The energy of expansion of the refrigerant that is recovered by the expansion mechanism 15 is transferred directly to the compression mechanism 13 through the shaft 5 in the form of mechanical force. The shaft 5 may be made of a single shaft or one in which a plurality of shafts are coupled coaxially.

In addition, as illustrated in FIG. 6B, a refrigeration cycle apparatus 80 that employs the compressor 81 and/or the expander 83, constructed as the rotary-type fluid machines of the present invention, is also suitable. Each of the compressor 81 and the expander 83 has a dedicated closed casing, and the closed casings are connected to each other by the oil balancing pipe 76 for making the amount of oil uniform. A flow rate adjusting valve 16 may be disposed in the oil balancing pipe 76. The energy of expansion of refrigerant is converted into electric power by a power generator that is built in the expander 83, which is used as part of the electric power necessary for driving the motor of the compressor 81.

INDUSTRIAL APPLICABILITY

The rotary-type fluid machine according to the present invention is suitable for a refrigeration cycle apparatus for constructing electric appliances such as air-conditioners, water heaters, driers, and refrigerator-freezers.

The invention claimed is:

1. A rotary-type fluid machine comprising: a closed casing having a bottom portion defining an oil reservoir; a rotary-type fluid mechanism provided in an upper portion of the closed casing, the rotary-type fluid mechanism having a cylinder forming a working chamber and a partitioning member, the working chamber partitioned into a suction side working chamber and a discharge side working chamber by the partitioning member;

a shaft having therein an oil supply passage for supplying oil to the fluid mechanism, the shaft connected to the fluid mechanism and extending to the oil reservoir;

an oil pump provided at a lower portion of the shaft; and an oil retaining portion for retaining oil, supplied by the oil pump through the oil supply passage, in a region around the fluid mechanism to allow the partitioning member of the fluid mechanism to be lubricated, the oil retaining portion formed so that a liquid level of the oil retained therein is positioned higher than a lower face of the partitioning member, wherein: the oil retaining portion is formed by an oil retention member disposed between an inner circumference surface of the closed casing and an outer circumference surface of the cylinder in a radial direction of the shaft, the oil retention member includes a cylindrical trunk portion surrounding the fluid mechanism circumferentially, and a canopy extending from the truck portion toward the center of the shaft, wherein the oil retention member is open at upper side of the canopy, the cylindrical trunk portion has an upper end that is positioned higher than the lower face of the partitioning member, and the oil that has overflowed the oil supply passage is retained by the cylindrical trunk portion and held in the region around the fluid mechanism.

2. The rotary-type fluid machine according to claim 1, further comprising an oil return passage for allowing the oil that has overflowed the oil retaining portion to return to the oil reservoir.

3. The rotary-type fluid machine according to claim 2, wherein:

the oil retaining portion is formed by a support for supporting the fluid mechanism, the support fixed to the closed casing, and the oil retention member; and the oil return passage is an opening for allowing the oil that has overflowed the oil retaining portion to flow out below the support, the opening being provided in the support.

4. The rotary-type fluid machine according to claim 2, wherein:

the oil retaining portion is formed by a support for supporting the fluid mechanism, the support fixed to the closed casing, and an oil return pipe fixed to the closed casing, one end of the oil return pipe opening toward the interior of the closed casing at a position higher than the lower face of the partitioning member and the other end thereof opening toward the interior of the closed casing at a position lower than the support; and the oil return pipe is the oil return passage.

5. The rotary-type fluid machine according to claim 2, further comprising a valve provided at an end or a halfway point of the oil return passage, the valve being capable of switching between two states, one state being an open state in which the oil that has overflowed the oil retaining portion is permitted to pass through the oil return passage and the other being a closed state in which the oil that has overflowed the oil retaining portion is prohibited to pass therethrough.

6. The rotary-type fluid machine according to claim 1, wherein:

the fluid mechanism is a multi-stage rotary type fluid mechanism comprising a plurality of the cylinders and a plurality of the partitioning members; and the oil retaining portion is formed so that the liquid level is positioned higher than the lower face of the partitioning member that is positioned farthest from the oil pump in a condition in which the rotary-type fluid machine is not in operation.

7. The rotary-type fluid machine according to claim 1, wherein a suction pipe for allowing a working fluid to be sucked from an outside of the closed casing to the suction side working chamber and a discharge pipe for allowing the working fluid to be discharged from the discharge side working chamber to the outside of the closed casing extend through the closed casing to be connected directly to the fluid mechanism respectively.

8. The rotary-type fluid machine according to claim 1, wherein the oil retention member further comprises a canopy extending toward the center of the shaft.

9. The rotary-type fluid machine according to claim 1, further comprising a second fluid mechanism disposed in a lower portion of the closed casing so as to be immersed in the oil of the oil reservoir, the second fluid mechanism coupled to the fluid mechanism serving as a first fluid mechanism by the shaft.

10. A refrigeration cycle apparatus comprising:

a compressor for compressing a refrigerant;

a radiator for cooling the refrigerant compressed by the compressor;

an expander for expanding the refrigerant cooled by the radiator; and an evaporator for evaporating the refrigerant expanded by the expander, wherein at least one of the compressor and the expander comprises a rotary-type fluid machine according to claim 1.

* * * * *

UNITED STATES PATENT AND TRADEMARK OFFICE

CERTIFICATE OF CORRECTION

PATENT NO. : 8,033,135 B2
APPLICATION NO. : 12/066450
DATED : October 11, 2011
INVENTOR(S) : Okaichi et al.

It is certified that error appears in the above-identified patent and that said Letters Patent is hereby corrected as shown below:

Column 18, line 9 (claim 1): “truck” should read -- trunk --.

Signed and Sealed this
Twenty-ninth Day of May, 2012

David J. Kappos

David J. Kappos
*Director of the United States Patent and Trademark Office*